US006761230B2

(12) United States Patent
Cross et al.

(10) Patent No.: US 6,761,230 B2
(45) Date of Patent: Jul. 13, 2004

(54) DOWNHOLE DRILLING APPARATUS AND METHOD FOR USING SAME

(75) Inventors: Barry W. Cross, Sugar Land, TX (US); Mario A. Araya, Sugar Land, TX (US); Keith A. Moriarty, Houston, TX (US); Kenneth W. Turner, Houston, TX (US); Jean-Michel Hache, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/065,372

(22) Filed: Oct. 10, 2002

(65) Prior Publication Data

US 2004/0045740 A1 Mar. 11, 2004

Related U.S. Application Data

(60) Provisional application No. 60/319,528, filed on Sep. 6, 2002.

(51) Int. Cl.[7] ..... E21B 44/02
(52) U.S. Cl. ..... 175/40; 175/45; 175/50
(58) Field of Search ..... 175/40, 45, 50, 175/325.1, 320

(56) References Cited

U.S. PATENT DOCUMENTS

| | | | | |
|---|---|---|---|---|
| 2,651,199 A | | 8/1953 | Collins et al. | |
| 4,265,305 A | | 5/1981 | Stone et al. | |
| 4,325,438 A | | 4/1982 | Zuvela | |
| 4,433,491 A | | 2/1984 | Ott et al. | |
| 4,537,067 A | * | 8/1985 | Sharp et al. | 73/151 |
| 4,779,852 A | | 10/1988 | Wassell | |
| 4,800,981 A | | 1/1989 | Uttecht et al. | |
| 4,932,471 A | | 6/1990 | Tucker et al. | |
| 4,993,493 A | | 2/1991 | Arnold | |
| 5,188,191 A | | 2/1993 | Tomek | |
| 5,432,699 A | | 7/1995 | Hache et al. | |
| 5,507,348 A | | 4/1996 | Van Steenwyk et al. | |
| 5,657,547 A | | 8/1997 | Uttecht et al. | |
| 5,678,630 A | | 10/1997 | Shaw et al. | |
| 5,767,674 A | | 6/1998 | Griffin et al. | |
| 5,934,378 A | | 8/1999 | Tchakarov | |
| 5,988,300 A | | 11/1999 | Pomerleau et al. | |
| 6,008,646 A | | 12/1999 | Griffin et al. | |
| 6,019,182 A | | 2/2000 | Rountree et al. | |
| 6,041,509 A | | 3/2000 | Shelyago | |
| 6,192,748 B1 | | 2/2001 | Miller | |
| 6,394,184 B2 | | 5/2002 | Tolman et al. | |
| 6,429,653 B1 | | 8/2002 | Kruspe et al. | |

FOREIGN PATENT DOCUMENTS

EP 1184539 A2 3/2002

OTHER PUBLICATIONS

US 6,151,553, 11/2000, Estes et al. (withdrawn).

Estes, R.A. et al., Development of a Robust Gyroscopic Orientation Tool for MWD Operations, SPE (Society of Petroleum Engineers) 63274, Oct. 1–4, 2000, pp. 1–13.

Rate Gyroscopic Surveyor–Applications, Energy Industry, Gryrodata Survey Applications: Rate Gyro Directional Wellbore Survey Systems, Gyrodata [retrieved on Oct. 11, 2002]. Retrieved from the Internet: <URL:www.gyrodata.com/applications.htm>.

MWD SCientific Drilling Gryro MWD, Scientific Drilling, Mar. 2002, [retrieved on Oct. 11, 2002]. Retrieved from the Internet: [URL:www.scientificdrilling.com].

* cited by examiner

*Primary Examiner*—William Neuder
(74) *Attorney, Agent, or Firm*—J.L. Jennie Salazar; Brigitte L. Jeffery; John Ryberg

(57) ABSTRACT

A method and apparatus is provided to support a gyroscope within a downhole drilling tool. A packaging system is positioned within a drill collar of the drilling tool and includes a housing for the gyro and at least one centralizer supporting the housing within the drill collar. The system may also be provided with a down-hole end cap, an up-hole endcap and a loading device. A gyro compression mechanism that is capable of holding wires may also be included to provide power and communication while compressing the gyro to isolate it from shock or vibration.

32 Claims, 4 Drawing Sheets

DOWNHOLE DRILLING APPARATUS AND METHOD FOR USING SAME

CROSS REFERENCE TO RELATED APPLICATIONS

This application claims priority from Provisional Application No. 60/319,528, filed Sep. 6, 2002.

BACKGROUND OF INVENTION

This invention relates generally to downhole tools for drilling wellbores. More particularly, this invention relates to downhole drilling tools capable of supporting gyroscopic tools for use in downhole operations.

The downhole drilling of wellbores, such as oil wells, involves extreme operating conditions for drilling equipment. Downhole drilling involves high temperatures, high pressure and rigorous physical impact. Much of the drilling occurs at extreme depths into the earths surface or deep below the sea bottom.

Dowhole devices, are often used in drilling operations to perform various tasks, such as monitoring wellbore conditions, operating the drilling tool and communicating with the surface. Many such devices have intricate electrical connections and instrumentation which have difficulty adapting to the wellbore conditions. The gyroscope, or "gyro," is one such tool used in downhole operations to perform tasks, such as determining downhole orientation.

Various devices have been developed to support gyroscopes within the drilling operation. For example, U.S. Pat. No. 5,507,348 issued to Scientific Drilling International discloses an apparatus for supporting instrumentation in a drill collar using elastomeric fins. While such developments may have provided techniques for supporting gyroscopes along a drilling tool, there remains a need to further adapt the gyroscope to the wellbore environment.

It is desirable to provide a means for protecting the gyroscope, support the gyroscope and enhance its ability to perform the desired tasks. It is further desirable to provide a system which allows easy loading and/or removal of the gyroscope into the drilling tool, while providing a packaging system that reduces shock and vibration, isolates the gyro from high pressures, and keep the gyro clean. An easy entry and exit system is needed for fast access to the gyro, preferably without taking the entire housing out of the collar or getting the gyro dirty. Thus, the gyroscope could be assembled at the rig. To meet these and other needs, the present invention has been developed.

SUMMARY OF INVENTION

A real time packaging system for a gyroscope (gyro) in a down-hole drilling tool is provided. The packaging system applies to gyroscopes used in the oilfield industry (ie. Rate-Gyros). The gyroscope is typically used during the drilling process for performing various downhole operations, such as providing down-hole orientation.

The packaging system is intended to permit the gyroscope and related downhole tool to perform under the severe drilling environments of the oilfield industry. The system allows a gyro to operate under high temperature, high pressure, and high shock or vibration and reduce the impact of such side effects to the gyro mechanism. In addition, the system allows for fast packaging procedures while maintaining the gyro clean and dry at all times.

The packaging system is positioned within a downhole drilling tool and lowered downhole into a wellbore for performing drilling operations. The packaging system is in a drill collar, and houses the gyroscope. The packaging system includes a housing for the gyro and one or more centralizers to support the housing within the drill collar. The packaging system may also be provided with a downhole end cap, an up-hole endcap, and a loading device.

The packaging system may be either integrally formed within a drill collar, or positioned therein. The drill collar is then connected, typically threadably connected, to the remainder of the downhole tool. The tool is provided with a loading device which retains the housing in the collar. In addition, the system may also be provided with a gyro compression mechanism that is capable of holding wires to provide power and communication while compressing the gyro to isolate it from shock or vibration.

In one aspect, the invention relates to a downhole drilling tool for drilling a wellbore into an earth formation. The drilling tool has a drill string with a drill bit at an end thereof. The downhole drilling tool comprises a drill collar connectable to the drill string, a housing positionable within the drill collar, a gyroscope sealably positionable within the housing; and at least one centralizer positionable between the housing and the drill collar whereby the housing is supported in the drill collar. The drilling tool may be provided with a telemetry system, such as the "POWERPULSE™" unit available from the assignee of the present application, for communicating uphole.

In another aspect, the invention relates to an apparatus for supporting a gyroscope in a drill collar of a downhole drilling tool. The apparatus comprises a housing adapted to receive a gyroscope and at least one centralizer for supporting the housing within the drill collar whereby the gyroscope is protected from downhole conditions. The housing is sealingly positionable within a drill collar. The apparatus may also comprise a downhole end cap; an uphole end cap; and a gyro compression mechanism capable of providing axial support for the gyroscope.

In yet another aspect, the invention relates to a method of supporting a gyroscope within a drill collar of a downhole drilling tool. The method comprises positioning a gyroscope within a housing in a drill collar, inserting a plug into a downhole end of the housing, and securing the gyroscope into the housing by applying axial compression to the gyroscope and locking the downhole end of the gyroscope in place.

Another method is provided for supporting a gyroscope within a drill collar of a downhole drilling tool, the drilling tool comprising a drill string connectable to the drill collar. This method comprises inserting a gyroscope into a housing between a first compression rod and a second compression rod, positioning the housing within the drill collar, and applying a compressive force to the gyroscope by advancing a plug into the housing whereby the gyroscope is compressed between the compression rods.

Other aspects and advantages of the invention will be apparent from the following description and the appended claims.

DETAILED DESCRIPTION

Figure 1:
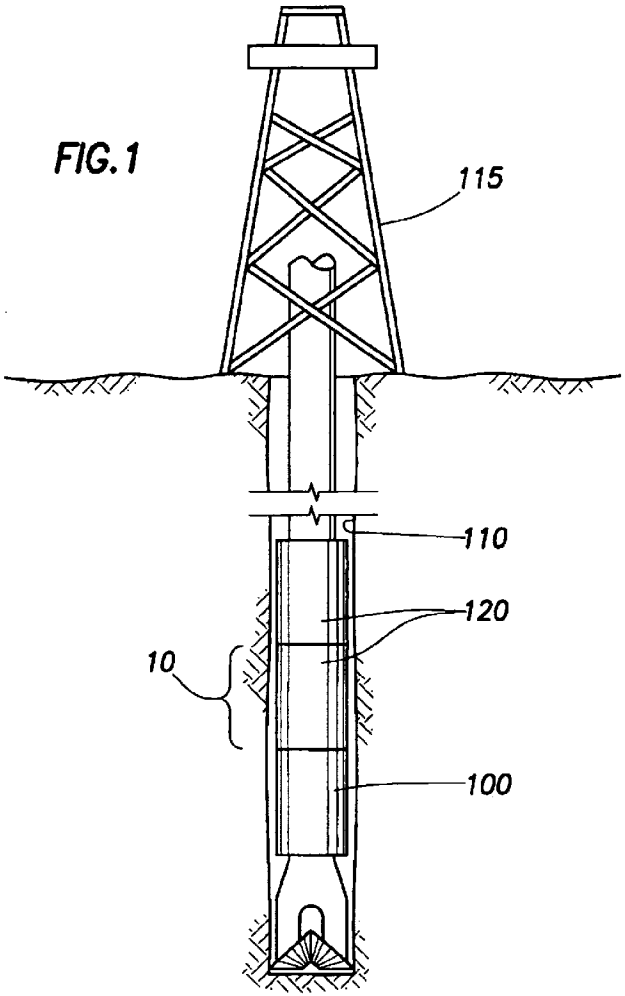
FIG. 1 is an elevational view, partially in section, of a conventional drilling rig and drilling tool employing the present invention.

FIG. 1 depicts the drilling environment relating to the present invention. A downhole drilling tool 100 is extended downhole from a rig 115 into a wellbore 110. The downhole drilling tool 100 has a plurality of drill collars 120 threadably connected to form a drill string. One such drill collar contains a packaging system 10 for a gyroscope. While the figures depict a downhole drilling tool, it will be appreciated that the packaging system may be positioned within any downhole tool, such as a wireline tool.

Figure 2:
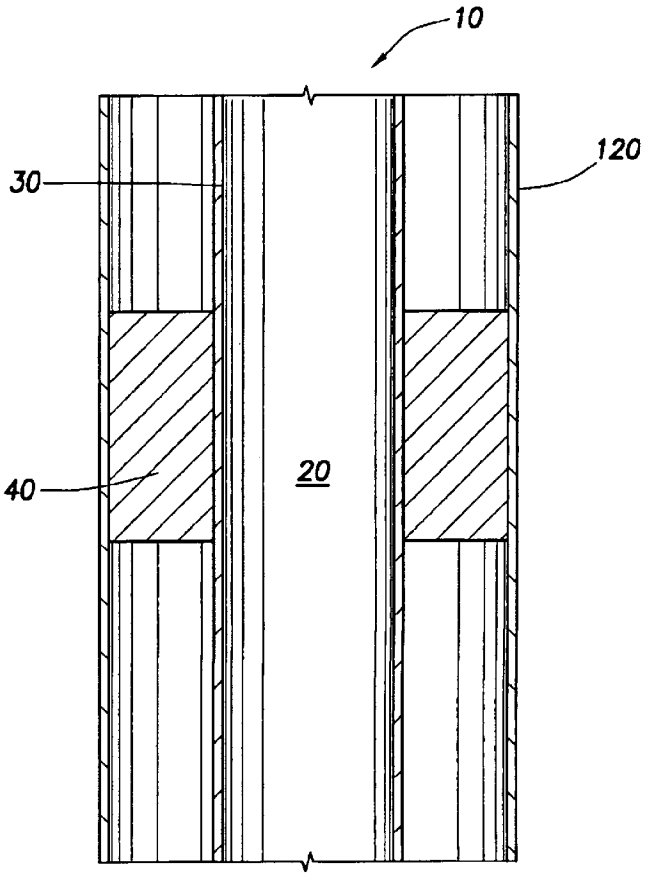
FIG. 2 is a schematic, cross sectional view of a portion of the drilling tool of FIG. 1 including a drill collar with a packaging system supporting a gyroscope.

Referring now to FIG. 2, a detailed view of the packaging system 10 of FIG. 1 is shown in greater detail. The packaging system 10 is positioned within a drill collar 120 and houses a gyroscope 20. The packaging system 10 may be either integrally formed within a drill collar, or positioned therein. The packaging system 10 includes a housing 30 for a gyroscope 20, and one or more centralizers 40. The centralizer 40 is positioned between the housing 30 and the drill collar 120 to support the housing 30 and gyro 20 within the drill collar. The centralizer also assists in protecting the gyro from exposure to wellbore conditions, such as shock, heat, and pressure. The packaging system is also preferably provided with a compression mechanism, a locking mechanism and/or a loading device which retains the housing in the collar, as will be described further herein.

Figure 3A:
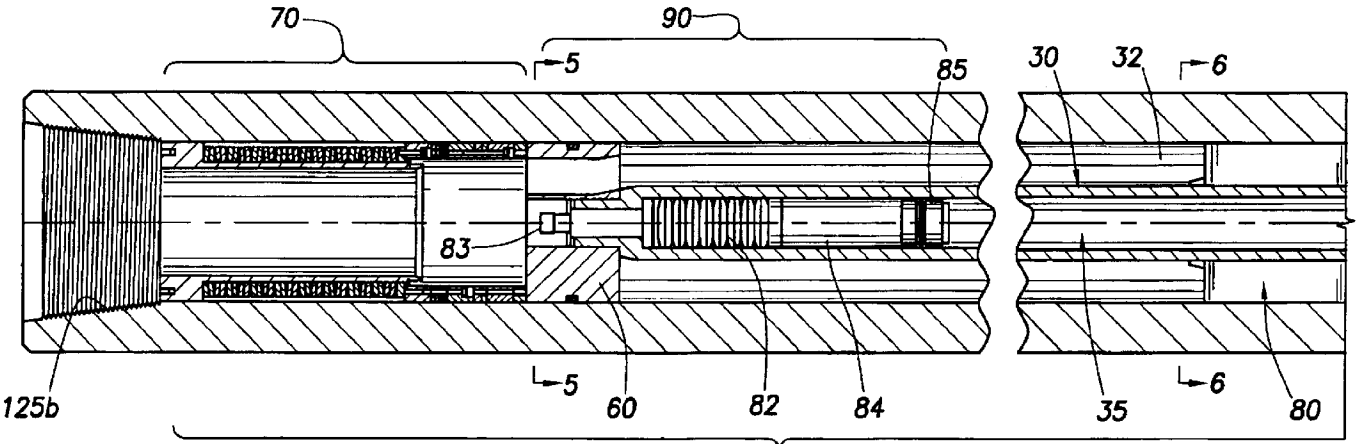
FIGS. 3A and 3B are a cross sectional view of the drill collar of FIG. 2 depicting the packaging system for supporting a gyroscope.
Figure 3B:
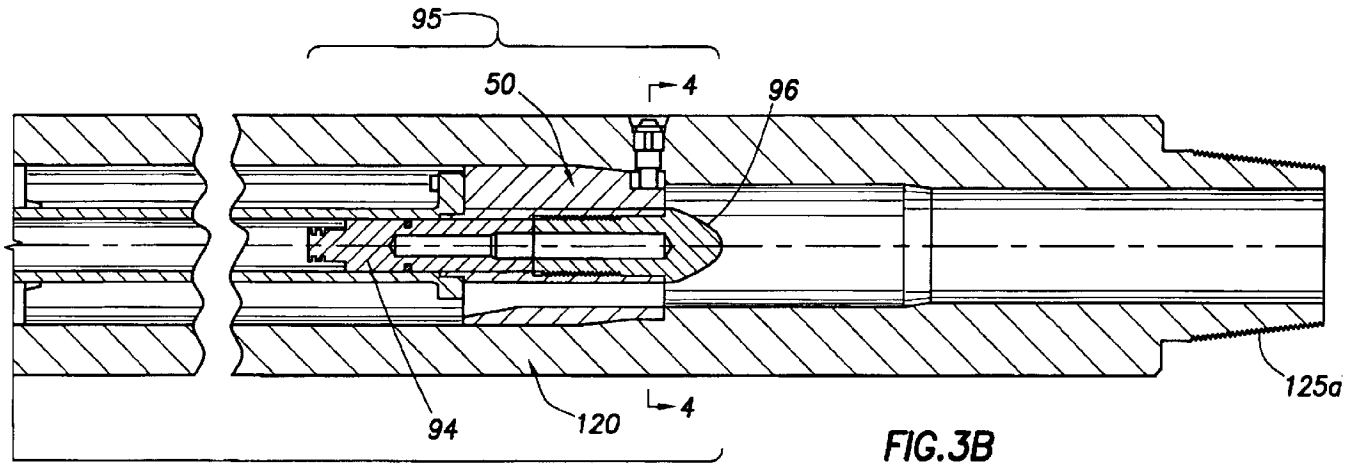

The drill collar 120 and related packaging system 10 are shown in greater detail in FIGS. 3A and 3B. The packaging system 10 is loaded into the drill collar 120. The drill collar is then connected, typically threadably connected, to the remainder of the downhole tool (ie. the drill string) via threaded ends 125*a* and 125*b* and adapted to connect to a drill string (FIG. 1). As detailed in FIGS. 3A and 3B, the packaging system 10 includes a housing 30 defining a cavity 35 for receiving a gyro, a down-hole end cap 50, an up-hole endcap 60, a loading device 70, and a centralizer 80. In addition, the system may be provided with a gyro compression mechanism 90 that is capable of holding wires to provide power and communication while compressing the gyro to isolate it from shock or vibration. The packaging system may also be provided with a locking mechanism 95 to releasably secure the packaging system 10 and gyro in place within the drill collar 120.

The housing 30 is preferably a tubular member positionable within any drill collar for use in downhole operations. The housing is long, thin, and contains a straight bore, preferably with a fairly tight tolerance for the gyro to minimize vibration. The housing provides a mud free, clean environment for the gyro to prevent it from getting stuck and to make it easier to retrieve. The housing is preferably a clean and pressure sealed area used to hold the gyro and the gyro compression mechanism. The housing provides a friendly environment for any gyro to provide protection from downhole conditions the gyro may not be able to withstand. The housing may be provided with an inner surface adapted to conform to the shape of the gyro.

The packaging system applies to any gyroscope capable of performing the intended downhole functions. Preferably, the gyroscope is one designed for use in the oilfield industry, often referred to as "Rate-Gyros," such as the ones created and/or used by Gyro/Data®, Incorporated (available at www.gyrodata.com), Baker Hughes® Incorporated (available at www.bakerhughes.com), or Scientific Drilling International, Inc. (available at www.scientificdrilling.com), among others. The preferred gyro is used to provide downhole orientation, and may be used in magnetic environments. Such gyros preferably provide measurement information, such as true-north toolface, inclination, azimuth, highside toolface, g-total, earth rate, and temperature.

The preferred gyro typically has a round shaft disposable into this packaging application. However, it will be appreciated by one of skill in the art, that various gyros of various geometries may be used in connection with the packaging system. Although the length and diameter of the gyro may vary, the packaging system applies to any size of gyro. The dimensions of the gyro may be modified to conform to the gyro structure and its position within the drill collar.

The housing 30 and the gyro are supported within the drill collar 120 by the downhole endcap 50, the uphole endcap 60 and one or more centralizers 80. Preferably a gap 32 exists between the housing 30 and the drill collar 120. The centralizers preferably position and center the housing for optimum protection and balance within the drill collar. The centralizers are typically cylindrical and symmetrical.

Figure 4:
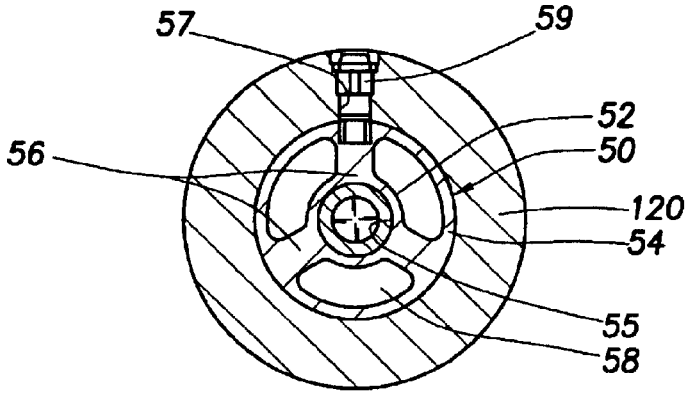
FIG. 4 is a detailed cross-sectional view of the drill collar of FIG. 3B taken along line 4—4 displaying the downhole end cap.

Referring to FIGS. 3B and 4, the downhole end cap 50 and the locking mechanism 95 are depicted. The downhole end cap 50 is shown in greater detail in FIG. 4. FIG. 4 shows a cross sectional view of the end cap taken along line 4—4. The downhole endcap 50 serves as an alignment system and a centralizer. The downhole endcap also provides an opening for fast assembly and disassembly of the gyro.

The down-hole end cap 50 is preferably a metal cylinder including an inner ring 52, an outer ring 54 and a plurality of struts 56 therebetween. Cavities 58 are positioned between the struts to allow mud to flow between the drill collar and the packaging system. The end cap 50 has a central bore 55 adapted to receive the locking mechanism 95 (FIG. 3B).

The downhole end cap 50 is preferably aligned within the collar 120 with the use of an alignment pin 59 that extends through the drill collar 120 and into a thin channel 57 on the end cap 50. The purpose of the alignment pin is to restrain the entire packaging system from rotating. The down-hole end cap 50 may also be attached to the housing 30 using bolts.

Referring back to FIG. 3B, the locking mechanism 95 is shown disposed within end cap 50 and extending into the cavity 35 of the housing 30. The locking mechanism 95 includes a gyro alignment device 94 and a bull plug 96. The bull plug 96 is axially aligned with the gyro alignment device 94. The bull plug may be connected to the gyro alignment device, or formed integrally therewith.

The bull plug 96 retains the gyro in place within the packaging system. The bull plug is sealably positionable within the end cap 50. Preferably, the bull plug is provided with threads to correspond to threads in the end cap and screws into the bottom end of the end cap.

The gyro alignment device 94 provides alignment for the gyro with respect to the end cap 50. The gyro alignment device 94 preferably contains a cross sectional pattern that matches the end cap and prevents the gyro from rotating inside the housing 30. The gyro is preferably further supported within cavity 35 by compression with the locking mechanism 95. As the bull plug is torqued, additional compression is adjustably applied to the gyro via the locking mechanism 95. This provides the downhole support for the gyro and the packaging system.

The locking mechanism 95 is removable from the housing to provide an opening to load and unload the gyro in and out of the housing. By enabling the gyro to be unloaded from the bottom end of the collar, the gyro can be inserted and taken out of the system without removing the housing from the collar. Furthermore, the locking mechanism is preferably screwed into the drill collar 120 to further compress the gyro (and the gyro compression mechanism) into the housing 30. The threads of the bull plug 96 provide the axial load needed to allow for hand operated loading and unloading. Furthermore, when the bull plug and/or the gyro alignment device compress the gyro, the housing provides structural support and prevents the housing from bending too drastically. Although a small bend in the gyro may occur, a small bend in the gyro typically aids in eliminating vibrations inside the housing due to the lateral forces that the gyro exerts against the housing.

Figure 5:
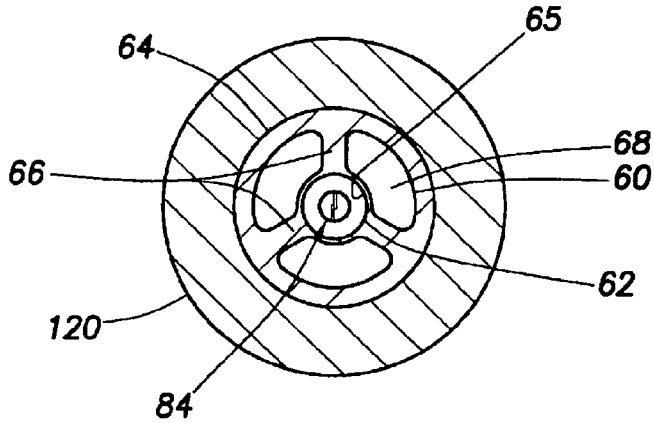
FIG. 5 is a detailed cross-sectional view of the drill collar of FIG. 3A taken along line 5—5 displaying the uphole end cap.

Referring now to FIGS. 3A and 5, the up-hole end cap 60 and the gyro compression mechanism 90 are depicted. FIG. 5 shows a cross section of the packaging system 10 containing the uphole end cap 60 taken along line 5—5 of FIG. 3A. The uphole end cap 60 screws into the up-hole end of the housing 30. The uphole end cap serves as a centralizer for the upper end of the gyro, but also holds the real time connection.

The uphole-hole end cap 60 is preferably a metal cylinder including an inner ring 62, an outer ring 64 and a plurality of struts 66 therebetween. Cavities 68 are positioned between the struts to allow mud to flow between the drill collar and the packaging system. The end cap 60 has a central bore 65 adapted to receive a portion of the housing 30 adjacent the gyro compression mechanism 90 (FIG. 3A).

The uphole end cap 60 provides stability and can be modified to take different types of connectors for communication with other tools. The end cap contains a bore 65 through which a connection with communication devices through the downhole tool can be made. For example, a connection may be made between the gyro and telemetry devices used for uphole communication, such as a POWERPULSE™ unit available from the assignee of the present invention.

As shown in FIG. 3A, the gyro compression mechanism 90 is positionable in the cavity 35 of the housing 30 and extends through uphole endcap 60. The gyro compression mechanism 90 is composed of a connector 84 and spring 82 capable of holding wires to provide power and communication for the tool. The connector 84 has an uphole end 83 positionable within and sealably connectable with the uphole end cap 60. The connector also has a downhole end 85 adapted to engage the gyro and apply force thereto to further secure the gyro within the packaging system.

The gyro compression mechanism 90 (FIG. 3A) is preferably attached to the gyro while the gyro is outside of the housing 30. The gyro compression mechanism preferably houses and protects wiring for the downhole tool. The gyro compression mechanism 90 holds electrical wires through a spring mechanism that provides a compressive force to the gyro and eliminates shock and vibrations. The wires are used to operate various portions of the downhole tool. The gyro compression mechanism 90 may be used to provide power and/or communication, and isolate the gyro from shock at the same time.

When the gyro, with the compression mechanism 90, is inserted into housing 30, the connector 84 extends through the up-hole end cap 60 for communication with other tools. The spring 82 in the compression mechanism 90 is compressed by screwing the bull plug 96 in the down-hole end cap 50. The gyro compression mechanism applies a compressive force to the gyro to further support the gyro within the housing. The spring 82 reduces the shock environment for the gyro and reduces axial gaps that may be present.

Figure 6:
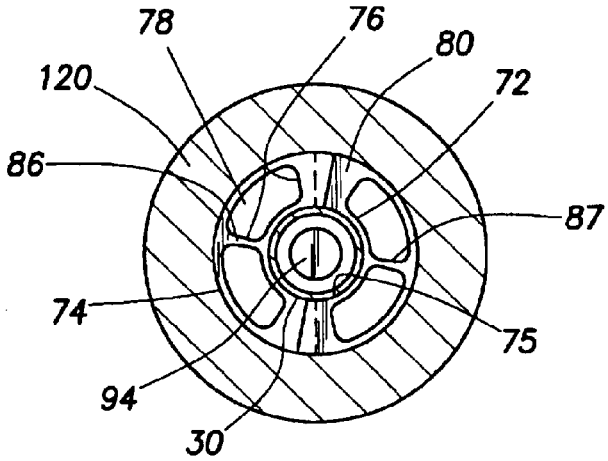
FIG. 6 is a detailed cross-sectional view of the drill collar of FIG. 3A taken along line 6—6 displaying the centralizer.

Referring to FIGS. 3A and 6, the centralizer 80 is depicted. FIG. 6 is a cross section of the packaging system 30 including the centralizer 80 taken along line 6—6. The centralizer 80 is positioned within the gap 32 to provide structural support for the housing 30. The centralizer 80 preferably fits snugly between the housing 30 and the drill collar 120 to secure the housing and gyro in position within the drill collar.

As best seen in FIG. 6, the centralizer 80 preferably includes a first portion 86 and a second portion 87. The portions may be connected via bolts, or other well known connectors. The portions are preferably metal and unite to form cylinder including an inner ring 72, an outer ring 74 and a plurality of struts 76 therebetween. Cavities 78 are positioned between the struts to allow mud to flow between the drill collar and the packaging system. The centralizer 80 has a central bore 75 adapted to receive the housing 30 (FIG. 3A).

The centralizer 80 is depicted in FIG. 6 as including two portions secured with bolts. The use of more than one portion enables easy assembly of the centralizer for a snug fit about the housing. However, it will be appreciated by one of skill in the art that the centralizer may be made from multiple portions, or integrally formed as a single piece.

Each of the centralizers, and/or endcaps functioning at least in part as centralizers, help to prevent the housing 30 from bending inside the collar 120. The centralizers are preferably composed of an outer cylinder and several struts that provide structural support for the cylinder. The centralizers position the gyro centrally within the drill collar and provide radial support. Preferably, the centralizers are made of metal, such as stainless steel or a steel alloy. However, other materials, such as elastomers, either in whole or in part, may also be contemplated.

Figure 7:
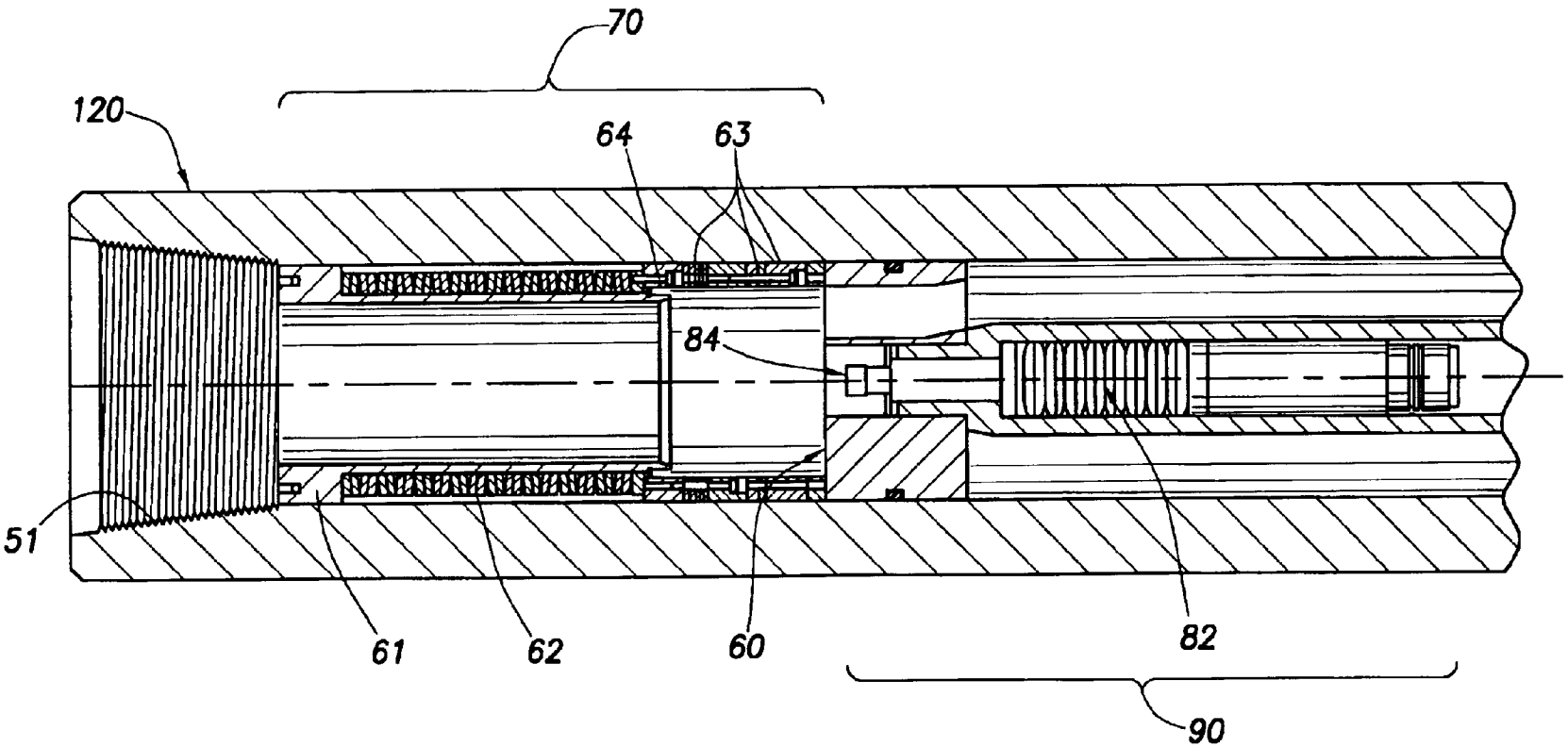
FIG. 7 is an enlarged view of a portion of the drill collar of FIG. 3A depicting the gyro compression mechanism.

Referring to FIGS. 3A and 7, the packaging system 10 may be provided with a loading device 70. FIG. 7 shows an enlarged view of the loading device 70 in the packaging system 10 of FIG. 3A. The loading device 70 is composed of a cylinder 61 with a spring system 62 that resides between the collar 120 and the cylinder 61. One or more spacer rings 63 may be positioned between the cylinder 61 and the uphole end cap 60 and connected thereto via bolts 64, or the like, as shown in FIG. 7.

The loading device used in combination with the packaging system may be an existing loading devices known by those of skill in the art, or other devices capable of applying a compressive force to assist in retaining the housing within the drill collar. The loading device ensures that the housing does not slide out of the collar and holds the housing inside the collar. When drill collar 120 is connected to another drill collar along the drill string, the pin end of the other drill collar is inserted into the opening 51 of drill collar 120 and compresses the cylinder 61 that in turn compresses the spring 62 and restrains the housing 30 from axial movement.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole drilling tool for drilling a wellbore into an earth formation, the drilling tool having a drill string with a drill bit at an end thereof, the downhole drilling tool comprising:

a drill collar connectable to the drill string;

a housing positionable within the drill collar;

a gyroscope sealably positionable within the housing; and at least one centralizer positionable between the housing and the drill collar whereby the housing is supported in the drill collar.

2. The downhole drilling tool of claim 1, wherein at least one centralizer is an endcap adapted to support an end of the housing in the drill collar.

3. The downhole drilling tool of claim 2, further comprising an alignment pin extending through the end cap and the drill collar.

4. The downhole drilling tool of claim 2, wherein the housing has an opening at a first end thereof, and wherein the tool further comprises a plug removably positionable within the opening.

5. The downhole drilling tool of clam 4, wherein the plug has an alignment rod extending therefrom, the alignment rod positionable adjacent the gyro.

6. The downhole drilling tool of claim 5, wherein advancement of the plug into the opening applies a compressive force to the gyro via the alignment rod.

7. The downhole drilling tool of claim 6, wherein the housing has a second end, and wherein the tool further comprises a compression rod disposable adjacent the gyro at the second end of the housing.

8. The downhole drilling tool of claim 7, wherein advancement of the plug into the opening applies a compressive force to the gyro via the compression rod.

9. The downhole drilling tool of claim 7, wherein the compression rod is adapted for connection to a telemetry device.

10. The downhole drilling tool of claim 9, further comprising a telemetry device positioned in the drill string, the telemetry device connectable to the gyro via the compression rod and capable of transmitting signals between the downhole tool and a surface communication unit.

11. The downhole drilling tool of claim 10, wherein the telemetry device is a mud pulser.

12. The downhole drilling tool of claim 1, wherein the at least one centralizer comprises an outer ring, an inner ring and a plurality of struts therebetween.

13. The downhole drilling tool of claim 1 further comprising a load mechanism comprising a spring loaded collar, the loading mechanism positionable in the drill collar between the housing and an end of the drill string such that advancement of the drill string into the drill collar applies a compressive force to the housing via the loading mechanism whereby the housing is secured within the drill collar.

14. An apparatus for supporting a gyroscope in a drill collar of a drill string, the drill string forming at least a portion of a downhole drilling tool, the apparatus comprising:

a housing adapted to receive a gyroscope, the housing sealingly positionable within the drill collar; and at least one centralizer for supporting the housing within the drill collar whereby the gyroscope is protected from downhole conditions.

15. The apparatus of claim 14, wherein at least one centralizer is an endcap adapted to support an end of the housing in the drill collar.

16. The apparatus of claim 15, further comprising an alignment pin extending through the end cap and the drill collar.

17. The apparatus of claim 15, wherein the housing has an opening at a first end thereof, and wherein the tool further comprises a plug removably positionable within the opening.

18. The apparatus of claim 17, wherein the plug has an alignment rod extending therefrom, the alignment rod positionable adjacent the gyro.

19. The apparatus of claim 18, wherein advancement of the plug into the opening applies a compressive force to the gyro via the alignment rod.

20. The apparatus of claim 19, wherein the housing has a second end, and wherein the tool further comprises a compression rod disposable adjacent the gyro at the second end of the housing.

21. The apparatus of claim 20, wherein advancement of the plug into the opening applies a compressive force to the gyro via the compression rod.

22. The apparatus of claim 20, wherein the compression rod is adapted for connection to a telemetry device.

23. The apparatus of claim 22, further comprising a telemetry device positioned in the drill string, the telemetry device connectable to the gyro via the compression rod and capable of transmitting signals between the downhole tool and a surface communication unit.

24. The apparatus of claim 23, wherein the telemetry device is a Powerpulse unit.

25. The apparatus of claim 14, wherein the at least one centralizer comprises an outer ring, an inner ring said a plurality of struts therebetween.

26. The apparatus of claim 14 further comprising a load mechanism comprising a spring loaded collar, the loading mechanism positionable in the drill collar between the housing and an end of the drill string such that advancement of the drill string into the drill collar applies a compressive force to the housing via the loading mechanism whereby the housing is secured within the drill collar.

27. An apparatus for supporting a gyroscope in a drill collar of a downhole drilling tool, comprising:

a housing adapted to receive a gyroscope, the housing positionable within a drill collar;

at least one centralizer for supporting the housing within the drill collar;

a downhole end cap;

an uphole end cap; and a gyro compression mechanism capable of providing axial support for the gyroscope.

28. The apparatus of claim 27 further comprising a loading device capable of retaining the housing inside the drill collar.

29. A method of supporting a gyroscope within a drill collar of a downhole drilling tool, comprising:

positioning a gyroscope within a housing in a drill collar;

inserting a plug into a downhole end of the housing; and securing the gyroscope into the housing by applying axial compression to the gyroscope and locking the downhole end of the gyroscope in place.

30. A method of supporting a gyroscope within a drill collar of a downhole drilling tool, the drilling tool comprising a drill string connectable to the drill collar, the method comprising:

inserting a gyroscope into a housing between a first compression rod and a second compression rod, the first compression rod seated against an end of the housing;

positioning the housing within the drill collar; and applying a compressive force to the gyroscope by advancing a plug into the housing adjacent the second compression rod whereby the gyroscope is compressed between the compression rods.

31. The method of claim 30, further comprising securing the housing within the drill collar by applying a compressive force to the housing within the drill string.

32. The method of claim 30, further comprising supporting the housing within the drill collar with one or more centralizers.

* * * * *